US007086994B2

(12) United States Patent
Turak et al.

(10) Patent No.: US 7,086,994 B2
(45) Date of Patent: Aug. 8, 2006

(54) COMBINATION SWIMMING, WALKING, RUNNING, MASSAGE, THERAPEUTIC, AND RECREATIONAL DEVICE

(75) Inventors: John A. Turak, Elizabethtown, PA (US); Anson J. Flake, Mechanicsburg, PA (US)

(73) Assignee: HydroWorx International, Inc., Middletown, PA (US)

( * ) Notice: Subject to any disclaimer, the term of this patent is extended or adjusted under 35 U.S.C. 154(b) by 0 days.

(21) Appl. No.: 09/369,508

(22) Filed: Aug. 6, 1999

(65) Prior Publication Data

US 2001/0051563 A1 Dec. 13, 2001

(51) Int. Cl.
*A63B 22/02* (2006.01)

(52) U.S. Cl. ..... 482/54; 482/51

(58) Field of Classification Search ..... 482/51, 482/54, 55, 56; 119/700; 4/492
See application file for complete search history.

(56) References Cited

U.S. PATENT DOCUMENTS

| | | | | | |
|---|---|---|---|---|---|
| 4,197,815 | A | * | 4/1980 | Brazelton | 4/492 |
| 4,918,766 | A | * | 4/1990 | Leonaggeo | 482/54 |
| 4,938,469 | A | * | 7/1990 | Crandell | 482/54 |
| 5,002,015 | A | * | 3/1991 | Sampson et al. | 119/700 |
| 5,108,088 | A | * | 4/1992 | Keller et al. | 482/54 |
| 5,558,604 | A | * | 9/1996 | Hopkins | 482/54 |

* cited by examiner

*Primary Examiner*—Glenn E. Richman
(74) *Attorney, Agent, or Firm*—Bruce J. Clark

(57) ABSTRACT

A combination single unit hydrotherapy and exercise device for allowing multiple exercises including both swimming and running in place, massage, and therapy, having a single seamless enclosure with stairs, and sufficiently long and deep for an adult to swim and stand in, a cavity with treadmill at the bottom with safety walk off ledge, external motor means connected to the treadmill shaft inside the enclosure, swim jets in the front to provide resistance to allow swimming in place, control and safety buttons at the top, treadmill impact absorption means, treadmill adjustment means from above the treadmill, and cavity next to the treadmill cavity for accessing the shaft.

8 Claims, 7 Drawing Sheets

COMBINATION SWIMMING, WALKING, RUNNING, MASSAGE, THERAPEUTIC, AND RECREATIONAL DEVICE

BACKGROUND OF INVENTION

This invention relates to the field of aquatic exercise, therapy, fitness and recreational devices.

Current devices related to this include spas used for recreation and massage; deep tank treadmill devices having a treadmill at the bottom of a deep tank of water, currently costing well over $100,000.00; large, shallower swim jet tanks allowing a swimmer to swim in place against the flow of fast moving water provided by swim jets placed at the front of the tank, also used primarily in commercial settings, and expensive as well. Except for the typical, small, home massage and swim spas, these individual devices are large, expensive and consequently utilized only in commercial applications.

Spas are popular in part because of their ability to be made inexpensively, and thus sold inexpensively. This is due primarily to the fact that they can be made in a single seamless unit using low cost manufacturing methods such as vacuum-forming thermo plastic. This method works because of the shallow nature of the spa (typically no more than 2–3 feet deep), that minimizes the need to consider excessive weight and water pressure problems. Other spa manufacturing processes include the forming of fiberglass or acrylic around a mold.

Conversely, a swim jet device has typically at least sixty (60) square feet of surface area (typically around 14 feet long by 4 to 5 feet wide) so that an adult swimmer can extend lengthwise with fully stretched arms during the swimming motion. Moreover, these tend to be deeper to allow the full downward extension of the arm during swimming. Consequently these devices are large and have required piece by piece construction of a large tank for that purpose. The extra depth of those devices provides additional significant water pressure at the lower depths as there can be 1500 to 2000 gallons of water in such a tank.

Aquatic treadmill chambers or pools require even additional depth so that an individual can stand at least chest high in the water while walking or running on the treadmill. At this level, it is often as much as 5 feet deep. Prior art treadmill devices include primarily chambers where an individual climbs in and water is brought in to that individual under a supervised setting, or larger pools where the treadmill is, in an expensive arrangement, raised to the top of the pool while the user walks on, then lowered down to the bottom. In either event, these devices can have typically several thousand gallons of water, and in a depth of 5 feet require special considerations for significantly greater weight and water pressure at the lower depths, and special considerations for easily allowing maintenance, adjustment of the treadmill, easy egress and ingress to the lower depths for patients in therapy that cannot walk up and down ladders, and require other individuals to assist either in supervising or raising or lowering of the treadmill platform; also extra safety considerations have to be taken into account as one runs in place on the treadmill at the bottom of the chamber. These enclosures are also usually constructed piece by piece rather than in a single seamless format.

To combine all three types of activities and devices discussed above into one seamless modular format results in a still larger pool that not only has large surface area for the swim in place swim jet arrangement, but also an extra deep pool to allow for one to stand up for the treadmill exercises, heretofore not done in any seamless device format that would allow for inexpensive construction that is structurally sound, easy to ship to the consumer, easy to install and use for consumer use, that is easy to maintain and adjust, and is likewise safe with minimized supervision required in the consumer setting.

It is therefore the object of this invention to provide just such a combination, multiuse device: an all in one, inexpensive, easy to use and maintain, primarily consumer device that is highly functional. This is accomplished by utilizing what is currently known to be the deepest vacuum thermo plastic created seamless spa tank. It utilizes unique design features to not only strengthen the structural integrity at the bottom depth of the pool, but also to provide an integrated treadmill receiving pan or cavity that secures the treadmill. It also allows the treadmill top to be flush with an integrated safety step off area around the treadmill, such that the snug fit in the pan leaves a minimal distance between the treadmill and the side of the container, at flush level, covered with a safety cover, all creating an attractive and safe, common, flush and level treadmill/floor bottom. An access chamber for access to the treadmill shaft is also provided. The tank has steps integrated into the tank structure, with rise and runs designed for the intended use. The tank has structural stiffening ribs encircling the tank in equivalently spaced relationship between the top and bottom of the container. This allows the tanks to combine for easy shipment of multiple units for mass production. Consequently the tank can be manufactured and shipped inexpensively, and installed easily, in relatively large numbers.

Other objects and features of the invention and the manner in which the invention achieves its purpose will be appreciated from the foregoing and the following description and the accompanying drawings which exemplify the invention, it being understood that changes may be made in the specific method and apparatus disclosed herein without departing from the essentials of the invention set forth in the appended claims.

DESCRIPTION OF THE PREFERRED EMBODIMENTS

Figure 1:
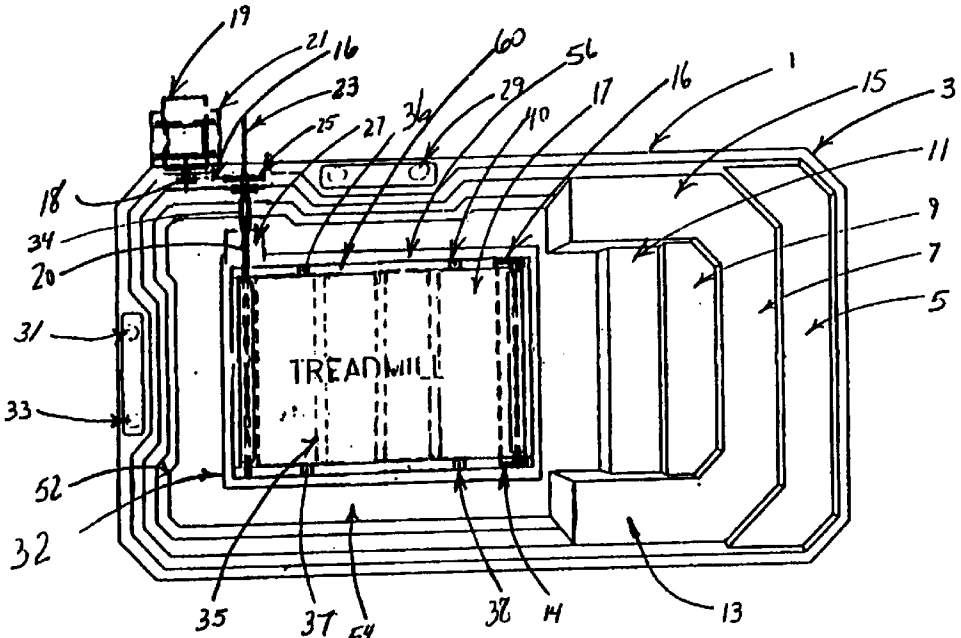
FIG. 1 is a top view of the invention.
Figure 2:
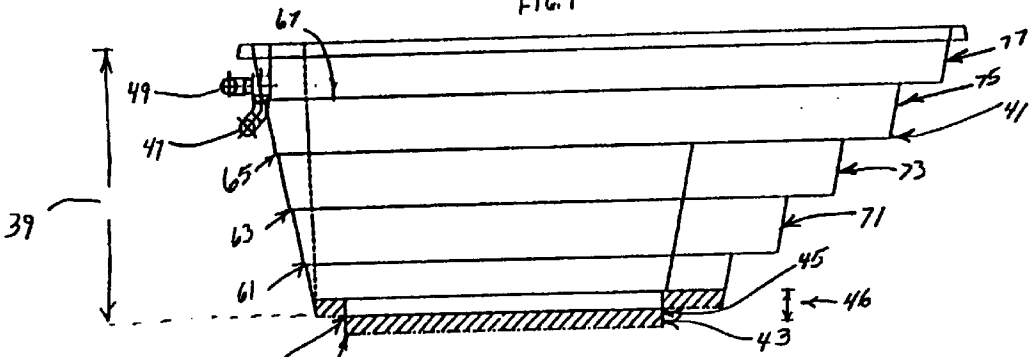
FIG. 2 is a side view of the invention.

The preferred mode of the invention is shown in FIG. 1. The tank 3 is, a single seamless enclosure, having a depth of at least 5 feet 4 inches. An individual can stand, run or walk on the treadmill 35. As discussed the seamless containers of this depth require special considerations for structural integrity due to the enormous amount of water pressure at the lower depths. Here, seamless refers to any molded device, whether built on top of a mold or vacuumed formed to a mold. Plastic, as used herein, refers to any polyvinyl, polymer, plastic material, man made or otherwise, and also includes acrylic and fiberglass.

Tank 3, at a minimum 14 feet long (sufficient to allow an adult individual to tread or swim at the top) provides for a minimum of 2200 gallons of water or more. Such an incredibly large amount of water creates tremendous water pressure at the lower depths. Moreover, the constant running and moving activity of an individual in the pool provides additional stress on the structure as the water is agitated at the lower depths. To create the single seamless tank of the tremendous size involved, capable of handling the moving treadmill and other significant water jet motion therein, special considerations must be given. A thermo plastic method for creating tubs is typically used where a large sheet of plastic material is heated and then pulled by vacuum (vacuum-formed) against the surface of a forming mold. To this inventor's knowledge, no vacuum-formed structure of this size and more particularly this depth has been created because of the difficulties in drawing the plastic to such a depth, while retaining the sufficient structural integrity at the lower depths to handle the greater water pressure and depths.

The invention not only achieves structural integrity by providing a smaller recess having stiffening bends and corners at 42, 43, 44 and 45 this recess structure also provides a treadmill receiving pan or cavity that also defines a safety step off landing.

Figure 3:
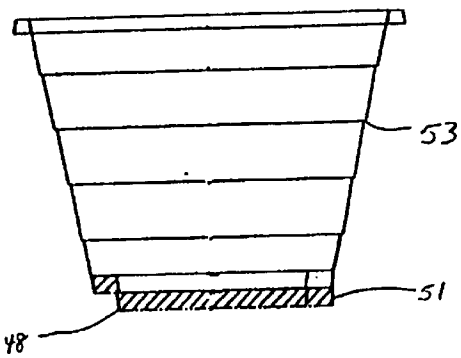
FIG. 3 is an end view of the invention.

The treadmill 35 fits snugly within the cavity and is attached utilizing screws and other affixing devices (that do not penetrate completely through the plastic structure), at 36, 37, 38 and 40. By having the recess perimeter 32 much smaller than the next highest rib 52, a safety walk off ledge 54 is created surrounding the treadmill. The spacing 56 around the treadmill between the treadmill and the tank perimeter 32 is minimized (in the preferred mode ¾ inch). A drive shaft access chamber 27 is created (shown also as 51 in FIG. 3) to allow the treadmill drive shaft to penetrate the tank. The chamber also provides clearance for assembling the treadmill into the tank. The treadmill shaft with corresponding drive wheel pulley shaft 23 and drive wheel pulley 25 so as to connect to the motor 19 sitting on motor mount 21, via the smaller motor pulley 18 and corresponding belt 16. A cover plate covers not only the maintenance access chamber 27, but also the gap 56 that surrounds the treadmill. The cover plate is preferably of flat stainless steel material approximately 5 inches wide in the preferred mode. The cover plate covers not only the outer frame 60 of the treadmill, but it also extends over to reach a small portion of the tank recess perimeter 32.

By creating the cavity 32 to fit the treadmill could create additional problems could be created by limiting access to adjust the tension of the treadmill. Obviously it is not desirable to empty the tank of 2200 gallons of water to make simple tension adjustments that sometimes are required on the treadmill. Consequently, it is necessary to adjust the treadmill from above without lifting the treadmill out, something that is extremely physically difficult at the depths of water involved. Belt tracking is also important for not only quality control, but to decrease maintenance requirements on the entire treadmill if the belt is not continuously maintained in an optimum position. Consequently easy access to adjust the belt by a typical consumer is important. This easy access is achieved via vertical access to an adjustment mechanism 14. One can simply extend into the water a long wrench, access the adjustment mechanism 14 from above in this fashion, and by turning the same either clockwise or counter-clockwise, adjust the belt tension. A similar corresponding adjustment mechanism 16 exists on the opposing side of the treadmill belt. Adjustment of these two in combination provides for the correct tensioning of the treadmill. A detailed description of the tension adjusting mechanisms 14 and 16 are discussed further herein.

To provide additional strength for such a large modular container, periodic ribs are spaced from top to bottom. In one mode, these ribs 61, 63, 65 and 67 also correspond with steps 71, 73, 75 and 77 (also 11, 9, 7 and 5).

In the swimming mode, swim jets 31 and 33 have outlets 47 and 49 connected to pump and motor means that forces water out the jets from the front end in which they are located to the opposing rear-end so as to create a sufficiently powerful and fast flow of moving water to allow a swimmer to swim in place, much like a runner runs in place on the treadmill. Controls at 29, in the preferred mode are comprised of a control panel board with the necessary switches to control not only the power and speed of the swim jets to allow for slower or faster swimming, but also the power and speed of the treadmill. The control panel also provides an emergency stop means.

Figure 4:
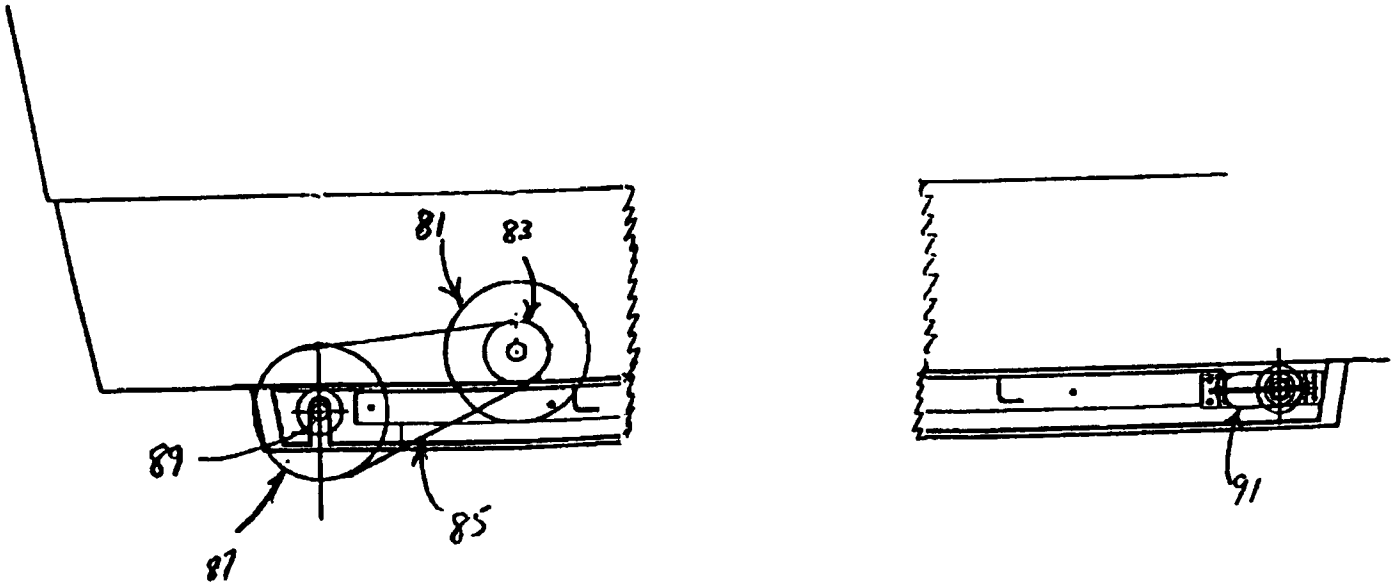
FIG. 4 is a side view of the bottom (middle portion of bottom omitted as indicated by line breaks) showing the motor at one end.

FIG. 4 discloses a close-up side view of the motor and treadmill assembly (on the opposing side wall from that shown in FIG. 1). The motor 81 rotationally moves the smaller pulley wheel 83 to rotate the belt 85 that is connected to the larger pulley 87 driving the shaft 89 to the treadmill. The shaft penetrates the tank through a hole provided in the tank located in the side of the treadmill receiving cavity. To prevent leaks, it is desired in the preferred mode that this portion of the pan (where that hole is drilled) be more vertical. A pressure seal is utilized between the 16 tank and the treadmill drive shaft.

Figure 5:
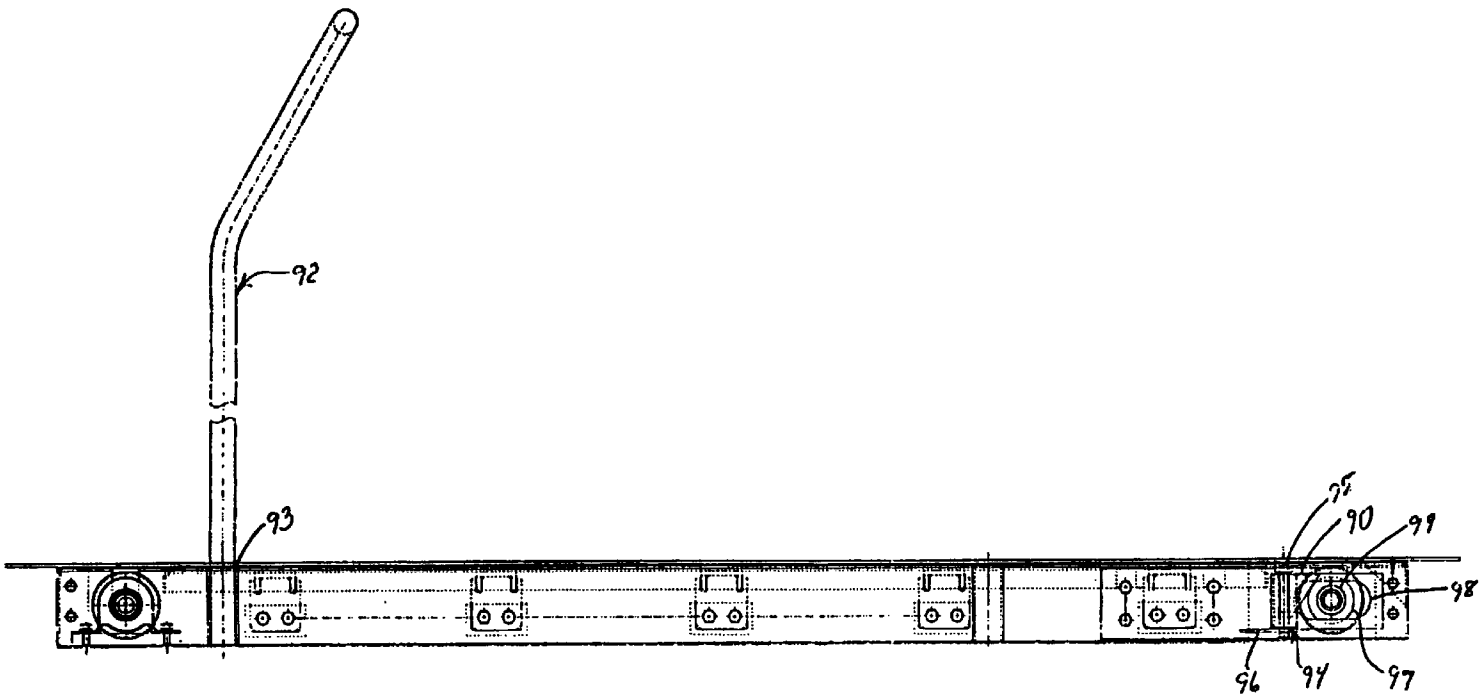
FIG. 5 is a side view of the treadmill.
Figure 6:
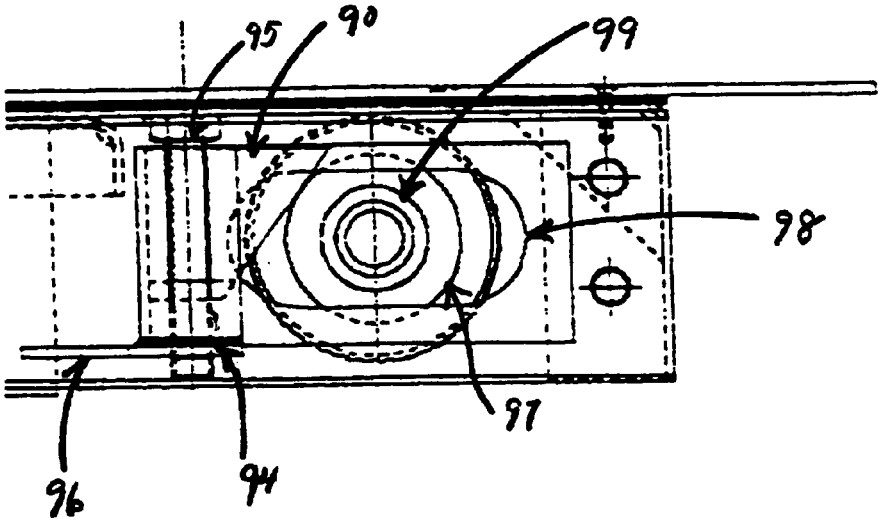
FIG. 6 is a side view of the tension adjusting mechanism.

Also shown in FIG. 4 is a side view of the tension adjustment means 91 shown in more detail in FIGS. 5 and 6, tension means is comprised of a rigid wedge shaped member 90 having elongated threaded hole 94 through which correspondingly threaded pin 95 extends, the non threaded tip of which extends through base plate 96. The pin is comprised of a hex headed bolt, access to which is gained through a hole in the frame of the treadmill. As the bolt is rotated counter-clockwise (looking down from above), the rigid wedge shaped member 94 is forced downward and places pressure against the treadmill roller 97 forcing the treadmill roller 97 backwards further into adjusting slot 98 in which the shaft 99 of the roller rests. Consequently, such an adjustment tightens the belt. To reduce the tension on the treadmill belt, the bolt-pin 95 is rotated in the opposite direction and correspondingly moves the wedge shaped member upwards allowing the treadmill roller and shaft to move forward.

FIG. 5 also shows a side view of the treadmill with optional support bar 92 removably inserted into corresponding holes 93 in the treadmill.

Figure 7:
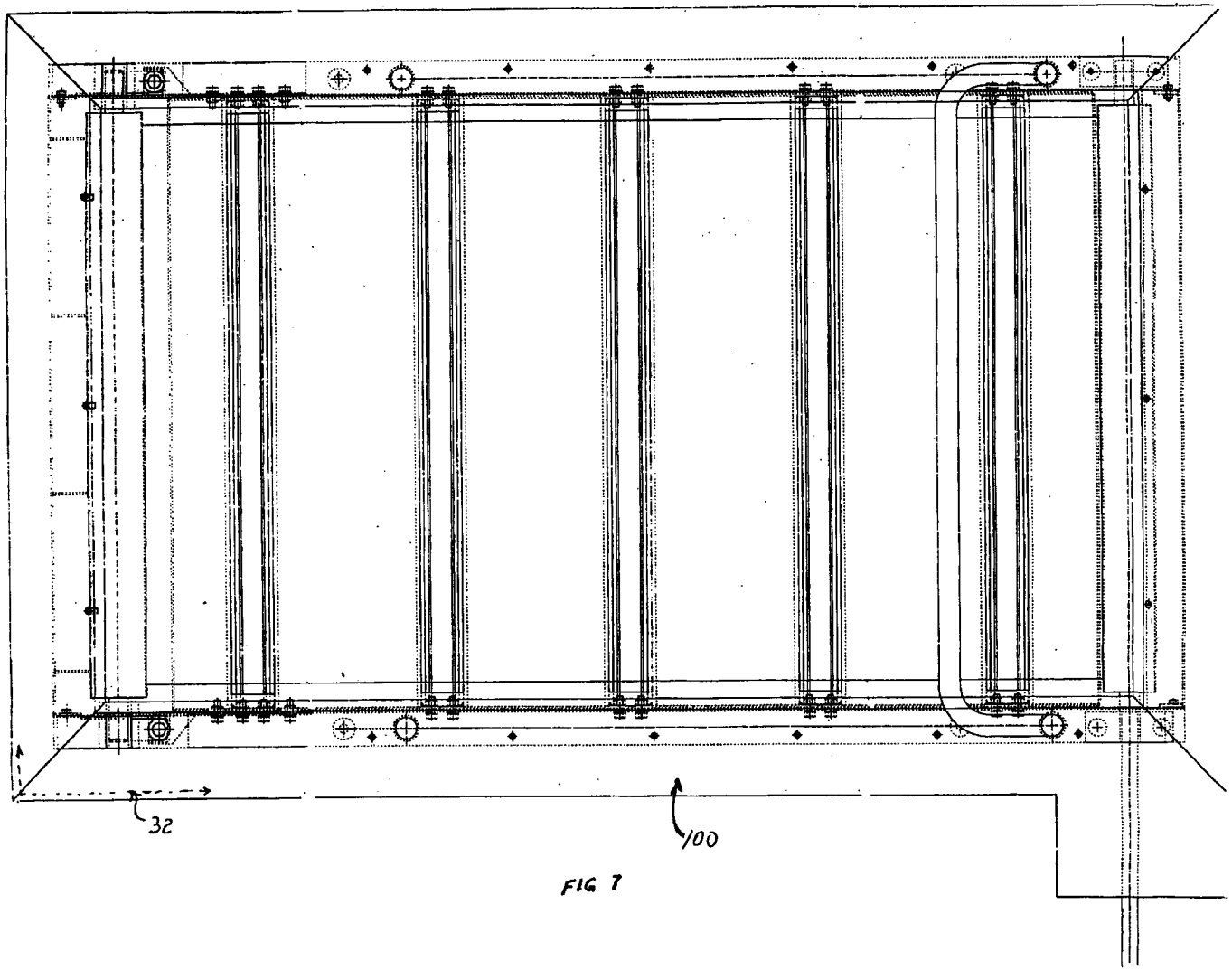
FIG. 7 is a top view of the treadmill.

FIG. 7 shows a top detailed view of the treadmill with cover plate 100. It will be seen that the cover plate extends over the lip 32 (32 in FIG. 1 and in FIG. 7 are the same) of the treadmill recess cavity in the tank.

Figure 8A:
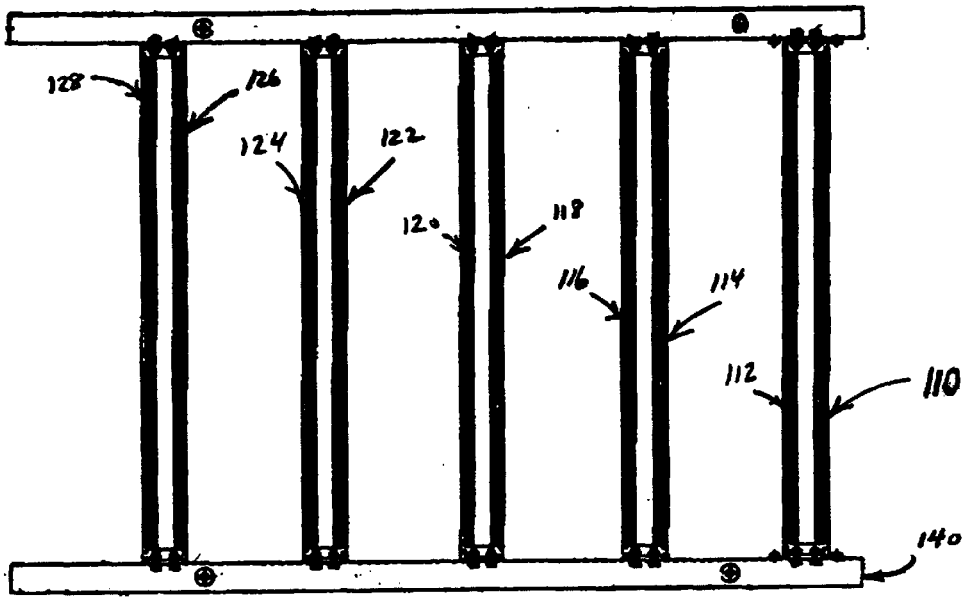
FIG. 8*a* is a top view of the treadmill assembly showing the cross-suspension base channels.
Figure 8B:
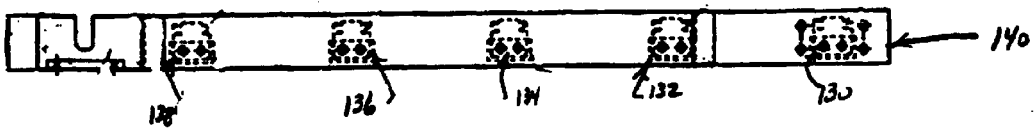
FIG. 8*b* is a side view of the treadmill assembly showing the individual suspension units.
Figure 9:
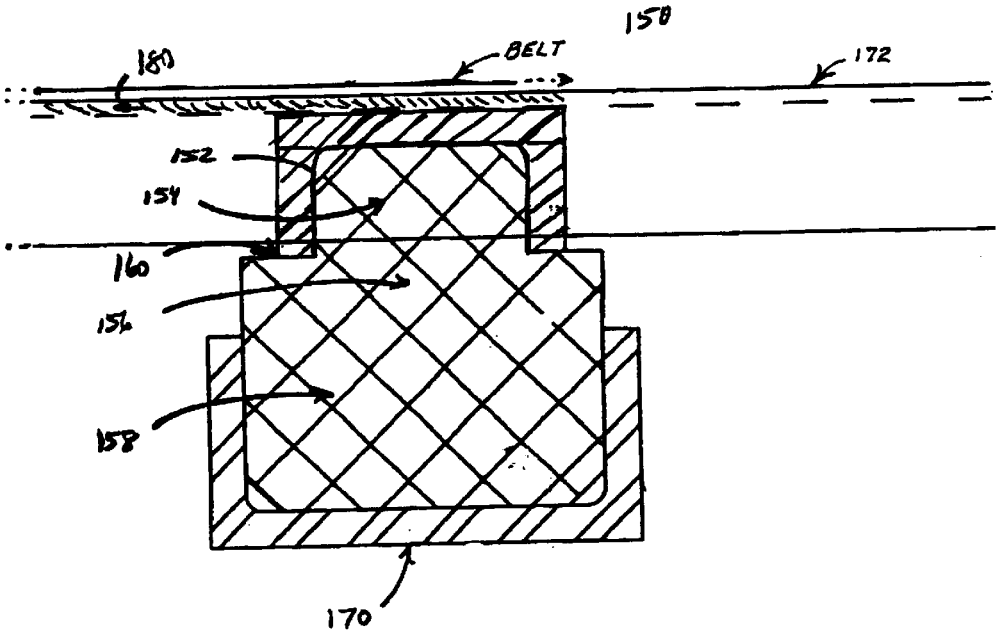
FIG. 9 is a side view of the individual suspension units.
Figure 1:
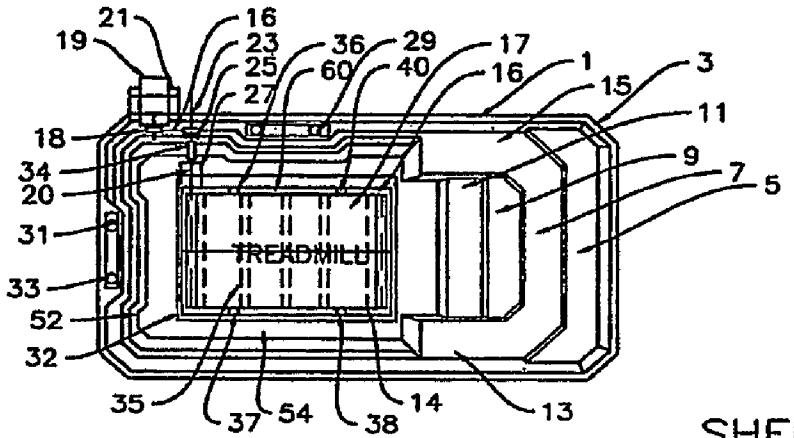
Figure 2:
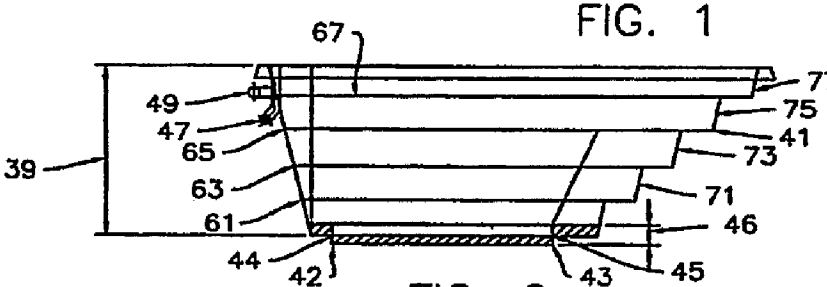
Figure 3:
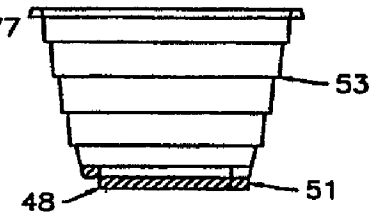
Figure 4:
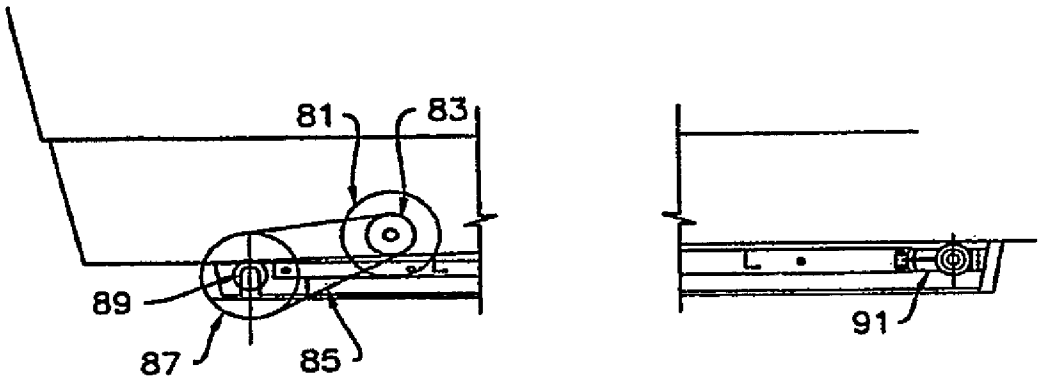
Figure 5:
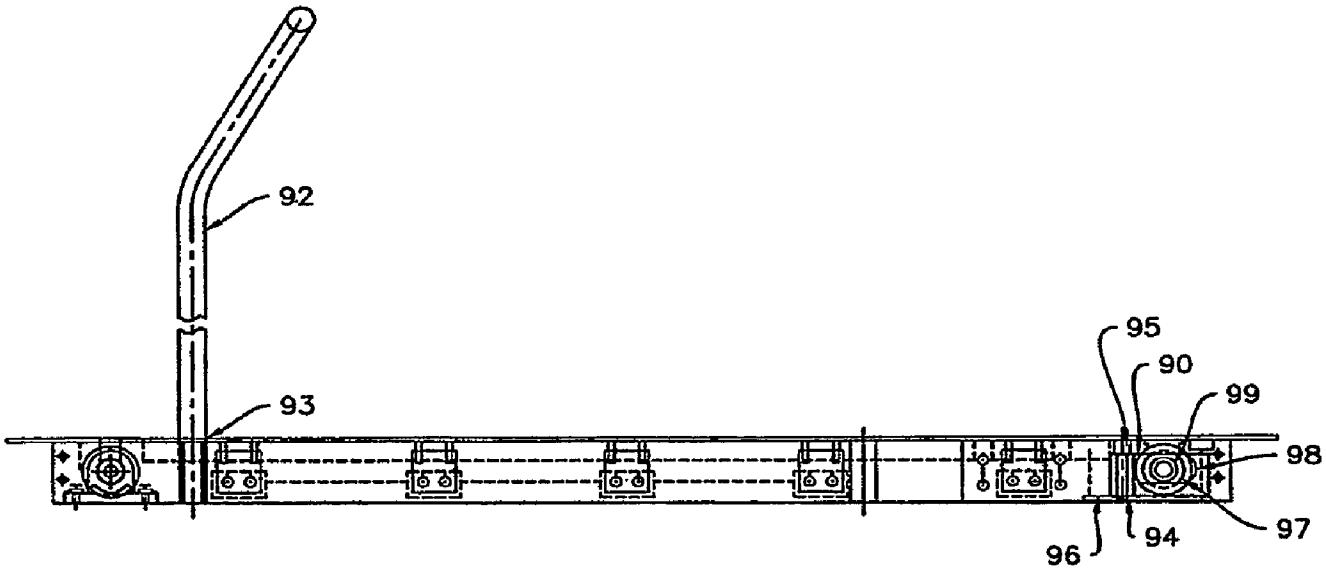
Figure 6:
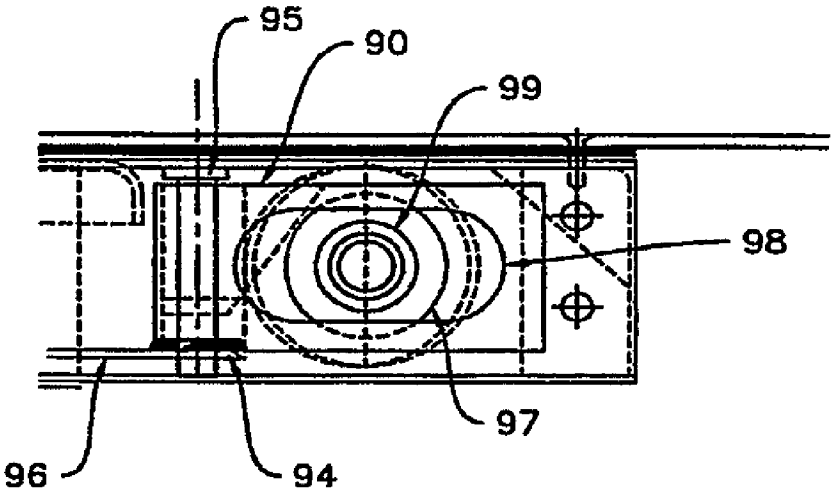
Figure 7:
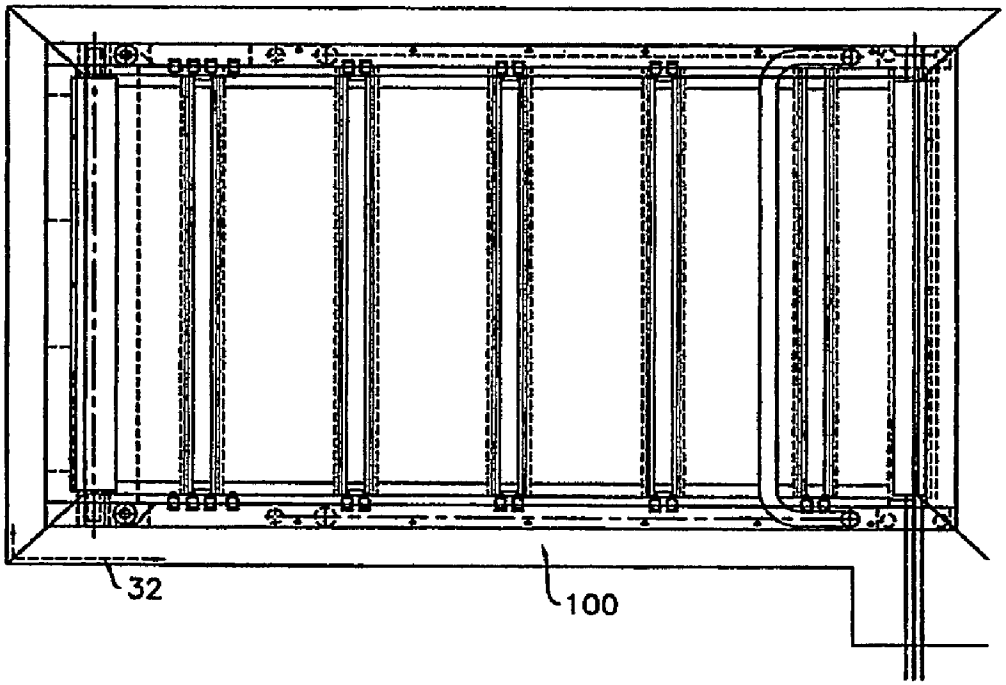
Figure 8A:
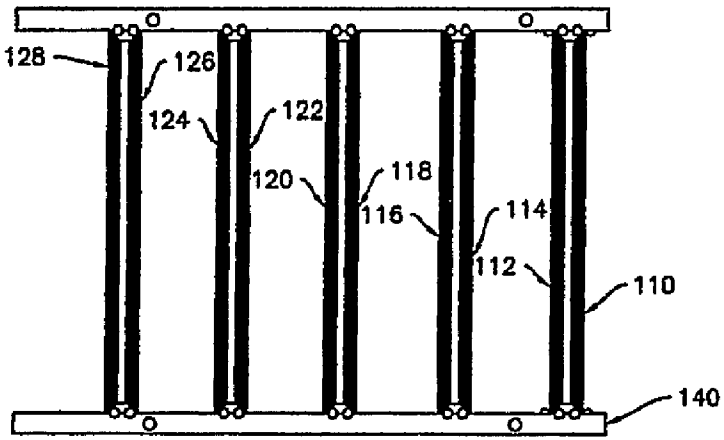
Figure 8B:
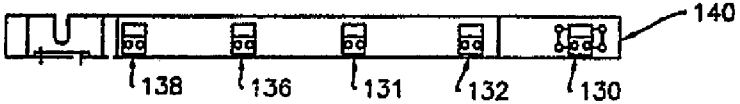
Figure 9:
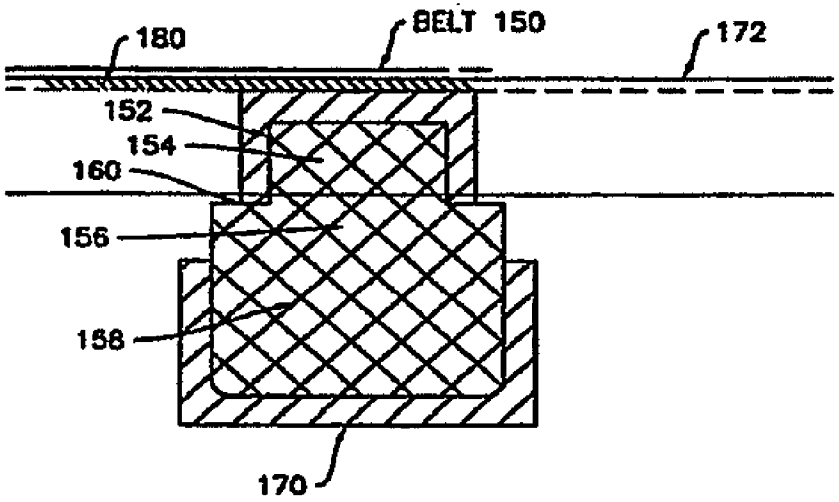

In the preferred mode, the treadmill has suspension/cushioning means, shown in FIGS. 8*a*, 8*b*, and 9, to cushion the impact of the feet against the treadmill so as to ease the impact physiologically on the feet, knees, legs, etc. during running. Upper channel members 110, 112, 14, 116, 118, 120, 122, 128 each have two ends, each end connected to the top portion of a suspension device (130, 132, 134, 136, 138, respectively) . Each suspension device is connected to rigid 'C' channel treadmill frame side members 146 respectively. The individual suspension devices are shown in more detail in FIG. 9. The upper channel member 150 is itself an upside down rigid 'C' channel member, for receiving in its interior 152 a correspondingly shaped top portion 154 of an elastomer member 156, which top portion is smaller than the bottom portion (base) 158 of the elastomer member 154, thus creating a 'stop' or ledge 160 for extra support and securability of the 'C' channel 150. The base 158 rests snugly upon, and is connected to, base member 170, which base channel member is connected to the frame of the treadmill and extends to the opposing side base channel member. 'C' channel 150 is smaller than 'C' channel 170 to provide clearance as the elastomer is compressed. The elastomer is defined as any material having the compression properties of a hard rubberlike material, that tend to compress or absorb energy upon impact. The treadmill upper platform 172, on which the treadmill belt rides, is connected to each of the upper channels. Thus, in use, when an impact occurs against the treadmill during running; the treadmill compresses the appropriate elastomer material of the corresponding suspension device, causing the elastomer to compress accordingly and absorb the energy of the impact. In another mode of the invention, the treadmill has padding means 180 for creating an additional cushion for impact absorption. The padding means 180 is comprised of any soft rubber-like material, or material having compression properties, situated on the underside of the platform 172.

Consequently, it will be seen that what has been invented is a single tank unit of a significant depth and size to allow an individual easy ingress and egress to exercise on the treadmill or a full length swim in place swim jet apparatus, that allows for safe use by the user by allowing for safety step off landing flush with the treadmill in a structurally sound fashion and one that allows relatively easy maintenance and access for tension adjustment at the significant depths involved. The single modular unit also allows for easy and inexpensive construction by allowing for thermo plastic vacuum-formed construction, and easy installation of a single unit.

While there have been shown and described particular embodi-ments of the invention, it will be obvious to those skilled in the art that changes and modifications may be made without departing from the invention or its equivalent, and, therefore, it is intended by the appended claims to cover all such changes and modifications as fall within the true spirit and scope of the invention.

What is claimed is:

1. A combination single unit hydrotherapy and exercise device for allowing aquatic exercise, massage, therapy and recreation, including any one of swimming, walking or running in place, comprised of:

a. A single seamless plastic enclosure having two ends and bottom there between;

b. An open top opposite the bottom, said top defining an outer perimeter sufficiently long and wide to allow a swimmer to swim in place, and having steps at one end as part of the single seamless enclosure to allow access from the top to the bottom where the bottom is sufficiently deep to allow an adult to stand in water at chest high;

c. A shaft receiving hole near the bottom of the enclosure;

d. Control buttons and safety stop buttons and means at the top of the enclosure;

e. A treadmill having a frame and a treadmill belt moved by a rotationally moving roller and shaft, said shaft extending from the treadmill to exit the wall of the enclosure through the shaft hole for connecting to exterior rotational motor means, said treadmill having a variable speed responsive to the control buttons;

f. Sealing means to seal the shaft exit hole about the shaft;

g. Swim jets at the front end of the enclosure and having means for providing sufficiently powerful water flow from the front to the back of the enclosure so as to provide sufficient resistance to allow swimming in place;

h. A treadmill receiving cavity at the bottom having a depth approximately the height of the treadmill and defining an area on at least three sides of the cavity to constitute a safety step off area.

2. The combination aquatic device in claim 1 having a treadmill with impact reducing means for reducing the impact of the feet on the treadmill.

3. The combination aquatic device in claim 2 wherein the treadmill with impact reducing means is comprised of a continuous loop treadmill belt having two sides, a treadmill frame having two sides defining the approximate sides to which the treadmill belt extend, a plurality of upper cross-members, a treadmill bed for supporting the belt, which bed is supported by a plurality of rigid supports, a plurality of individual energy absorption means supporting each of the treadmill rigid supports at the sides.

4. The combination aquatic device in claim 1 having treadmill belt adjustment means capable of adjusting the tension of the belt from above the treadmill while the treadmill is in the treadmill receiving cavity.

5. The combination aquatic device in claim 4 wherein the treadmill belt adjustment means are comprised of a wedge shaped rigid member having a threaded screw therein vertically moving the wedge shape in response to rotational movement of the screw, such that the wedge portion provides vertical movement towards and away from a treadmill roller.

6. The aquatic device in claims 1, 2 or 3 having a cover plate surrounding the treadmill for covering the treadmill frame and a portion of the step off ledge, and further having an access cavity in the enclosure adjacent the treadmill receiving means, for access to the treadmill shaft.

7. A combination single unit hydrotherapy and exercise device for allowing aquatic exercise, massage, therapy and recreation, including any one of swimming, walking or running in place, comprised of:

a. A single seamless enclosure having two ends and a bottom therebetween, and having a top half and bottom half;

b. An open top opposite the bottom, said top defining an outer perimeter sufficiently long and wide to allow a swimmer to swim in place, and having steps at one end as part of the single seamless enclosure to allow access from the top to the bottom where the bottom is sufficiently deep to allow an adult to stand in water at chest high:

c. A shaft receiving hole near the bottom of the enclosure;

d. Control buttons and safety stop buttons and means;

e. A treadmill having a frame and a treadmill belt moved by a rotationally moving roller and shaft said shaft extending from the treadmill to exit the wall of the enclosure through the shaft hole for connecting to exterior rotational motor means, said treadmill having a variable speed responsive to the control buttons;

f. Sealing means to seal the shaft exit hole about the shaft;

g. Jets at the front end of the enclosure in the top half and having means for providing sufficiently powerful water flow from the front to the back of the enclosure so as to provide sufficient resistance to allow swimming in place;

h. A treadmill receiving cavity at the bottom having a depth approximately the height of the treadmill and having a safety step off area adjacent the treadmill.

8. A combination single unit hydrotherapy and exercise device for allowing aquatic exercise, massage, therapy and recreation, including any one of swimming, walking or running in place, comprised of:

a. A single seamless enclosure having two ends and a bottom therebetween, and having a top half and bottom half;

b. An open top opposite the bottom, said top defining an outer perimeter sufficiently long and wide to allow a swimmer to swim in place, and having steps at one end as part of the single seamless enclosure to allow access from the top to the bottom where the bottom is sufficiently deep to allow an adult to stand in water at chest high:

c. A shaft receiving hole near the bottom of the enclosure;

d. Control buttons and safety stop buttons and means;

e. A treadmill having a frame and a treadmill belt moved by a rotationally moving roller and shaft said shaft extending from the treadmill to exit the wall of the enclosure through the shaft hole for connecting to exterior rotational motor means, said treadmill having a variable speed responsive to the control buttons;

f. Sealing means to seal the shaft exit hole about the shaft;

g. Jets at the front end of the enclosure in the top half and having means for providing sufficiently powerful water flow from the front to the back of the enclosure so as to provide sufficient resistance to allow swimming in place;

h. A treadmill receiving cavity at the bottom for receiving the treadmill.

* * * * *

UNITED STATES PATENT AND TRADEMARK OFFICE

CERTIFICATE OF CORRECTION

PATENT NO. : 7,086,994 B2
APPLICATION NO. : 09/369508
DATED : August 8, 2006
INVENTOR(S) : Turak et al.

It is certified that error appears in the above-identified patent and that said Letters Patent is hereby corrected as shown below:

The title page showing the illustrative figure should be deleted and substitute with the attached title page.

The drawing sheet, consisting of Fig. 1-9, should be deleted and replaced with drawing sheet, consisting of Fig. 1-9, as shown on the attached page.

Signed and Sealed this

Eighteenth Day of September, 2007

JON W. DUDAS
*Director of the United States Patent and Trademark Office*

(12) United States Patent
Turak et al.

(10) Patent No.: US 7,086,994 B2
(45) Date of Patent: Aug. 8, 2006

(54) COMBINATION SWIMMING, WALKING, RUNNING, MASSAGE, THERAPEUTIC, AND RECREATIONAL DEVICE

(75) Inventors: John A. Turak, Elizabethtown, PA (US); Anson J. Flake, Mechanicsburg, PA (US)

(73) Assignee: HydroWorx International, Inc., Middletown, PA (US)

( * ) Notice: Subject to any disclaimer, the term of this patent is extended or adjusted under 35 U.S.C. 154(b) by 0 days.

(21) Appl. No.: 09/369,508

(22) Filed: Aug. 6, 1999

(65) Prior Publication Data

US 2001/0051563 A1 Dec. 13, 2001

(51) Int. Cl.
*A63B 22/02* (2006.01)

(52) U.S. Cl. ..... 482/54; 482/51

(58) Field of Classification Search ..... 482/51, 482/54, 55, 56; 119/700; 4/492
See application file for complete search history.

(56) References Cited

U.S. PATENT DOCUMENTS

| | | | | | |
|---|---|---|---|---|---|
| 4,197,815 | A | * | 4/1980 | Braselton | 4/492 |
| 4,918,766 | A | * | 4/1990 | Leonaggeo | 482/54 |
| 4,938,469 | A | * | 7/1990 | Crandall | 482/54 |
| 5,002,015 | A | * | 3/1991 | Sampson et al. | 119/700 |
| 5,108,088 | A | * | 4/1992 | Keller et al. | 482/54 |
| 5,558,604 | A | * | 9/1996 | Hopkins | 482/54 |

* cited by examiner

*Primary Examiner*—Glenn E. Richman
(74) *Attorney, Agent, or Firm*—Bruce J. Clark

(57) ABSTRACT

A combination single unit hydrotherapy and exercise device for allowing multiple exercises including both swimming and running in place, massage, and therapy, having a single seamless enclosure with stairs, and sufficiently long and deep for an adult to swim and stand in, a cavity with treadmill at the bottom with safety walk off ledge, external motor means connected to the treadmill shaft inside the enclosure, swim jets in the front to provide resistance to allow swimming in place, control and safety buttons at the top, treadmill impact absorption means, treadmill adjustment means from above the treadmill, and cavity next to the treadmill cavity for accessing the shaft.

8 Claims, 7 Drawing Sheets

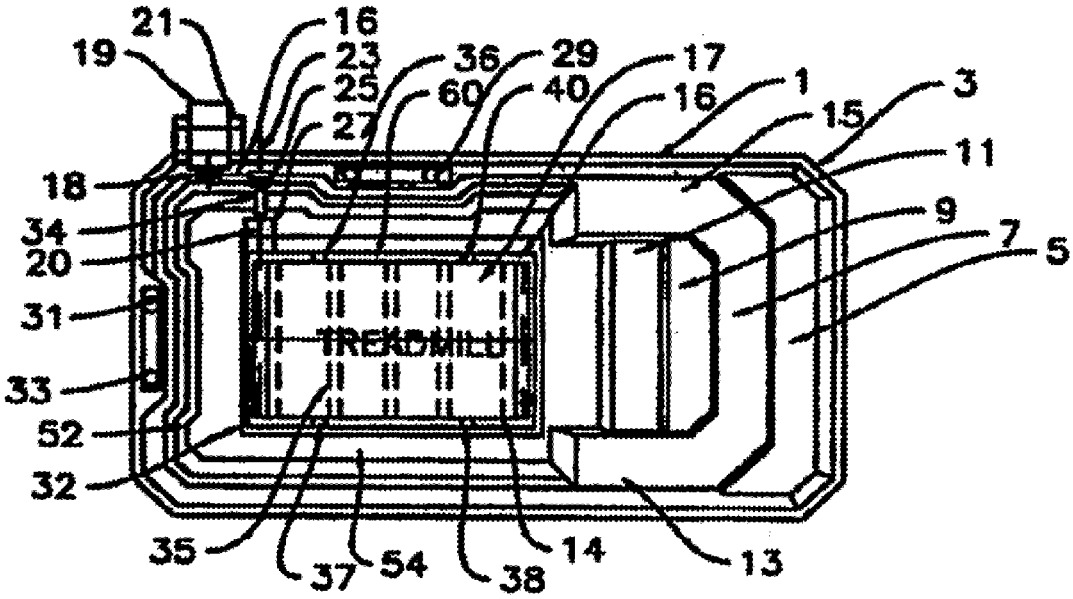

SHEET 1 OF 7

SHEET 2 OF 7

SHEET 3 OF 7

SHEET 4 OF 7

SHEET 5 OF 7

SHEET 6 OF 7

SHEET 7 OF 7